United States Patent [19]

Page

[11] Patent Number: 4,897,977

[45] Date of Patent: Feb. 6, 1990

[54] S-BAR REFRACTORY ANCHORS WITH ELLIPTICAL TAB

[75] Inventor: Gary L. Page, Ponca City, Okla.

[73] Assignee: Conoco Inc., Ponca City, Okla.

[21] Appl. No.: 274,513

[22] Filed: Nov. 21, 1988

[51] Int. Cl.[4] ..... E04B 1/24; E04C 2/04

[52] U.S. Cl. ..... 52/378; 52/598; 52/735; 110/339

[58] Field of Search ..... 52/378, 599, 334, 443, 52/598, 735; 110/339, 340

[56] References Cited

U.S. PATENT DOCUMENTS

| | | | |
|---|---|---|---|
| 2,064,910 | 12/1936 | Harper | 52/673 |
| 2,495,870 | 1/1950 | Soukup | 52/750 |
| 4,581,867 | 4/1986 | Crowley | 52/378 |

*Primary Examiner*—James L. Ridgill, Jr.
*Attorney, Agent, or Firm*—Richard W. Collins

[57] ABSTRACT

S-bar refractory anchors having at least one elliptical tab formed in the main body section are resistant to stress cracking.

2 Claims, 1 Drawing Sheet

S-BAR REFRACTORY ANCHORS WITH ELLIPTICAL TAB

BACKGROUND OF THE INVENTION

1. Field of the Invention

This invention relates to anchors for refractory linings in process equipment, and more particularly to improved anchors which are less subject to stress cracking than previously available anchors.

2. The Prior Art

Refractory linings have been used for many years in process vessels, reactors, conduits, furnaces and the like to provide thermal insulation, and in environments such as fluidized catalytic reactors or regenerators or stacks to provide resistance to abrasion or erosion. Such linings can serve not only to thermally insulate a shell or other surface but also to prolong its service life by shielding it from erosion by abrasion. In fluid catalytic cracking units for petroleum hydrocarbons, quite high fluid velocities which may be on the order of 50 to 70 ft/second occur, and the abrasive effect of entrained cracking catalyst is very pronounced. Moreover, high temperatures are involved. For example, in the regenerator the temperature of gases exiting through the cyclones may be on the order to 1250°-1350° F. and in the reactor the temperature may be 800°-900° F. Accordingly, the usual practice has been to line all vessels, conduits and cyclone separators through which fluid with entrained catalyst flows with a refractory lining to protect the metal surfaces and to provide thermal insulation. To retain the refractory, which may be a refractory cement, a concrete cement-aggregate mixture, or a reinforced cement or concrete, on the metal surface, various anchoring arrangements have been employed.

Heretofore, a preferred anchorage arrangement which also provided erosion protection was the use of hexagonal steel grating which was welded to the vessel or conduit wall. The grating had the same depth as the refractory lining to be applied, and the refractory was deposited in the hexagonal spaces defined by the grating. Thus, the grating provided the desired erosion resistance for the refractory by projecting to the exposed surface of the refractory. The disadvantages of hexagonal grating are its relatively high cost, lack of flexibility, which makes it difficult or impossible to apply to curved surfaces, its tendency to separate from the vessel or conduit wall over relatively large areas when welds fail, and its unsuitability for use with fiber reinforced refractories or with refractory concretes containing coarse aggregate particles.

In situations where hexagonal grating is not suitable, weldable studs have been proposed. Such studs are suitable for use with fiber reinforced refractory or with refractory concrete, but do not provide significant erosion protection for the refractory.

In recent years, an anchor commonly called an S-bar anchor has been developed. U.S. Pat. No. 4,479,337 to Crowley, contains a comprehensive description of S-bar anchors and their use. S-bar anchors of the type disclosed therein have met with considerable success, and have been widely used. However, the S-bar anchors as described therein have had certain problems in service, and there has been a need for an improved S-bar anchor which is not subject to the problems of prior art S-bar anchors.

SUMMARY OF THE INVENTION

In accordance with the present inention, an S-bar anchor which is resistance to stress cracking is provided. Prior art S-bar anchors were formed in a manner such that sharp corners existed at the intersection of the extension arms and the main anchor body, and also at the corner of tabs formed in the main body of the anchors. In actual use, these sharp corners led to stress concentrations with resultant cracking and eventual failure of the anchor.

The anchors in accordance with the invention are formed without the sharp corners which led to problems in prior art anchors.

It is therefore an object of the present invention to provide an improved S-bar anchor which is not subject to destructive stress concentrations in use.

THE DRAWINGS

DESCRIPTION OF THE PREFERRED EMBODIMENTS

Figure 3:
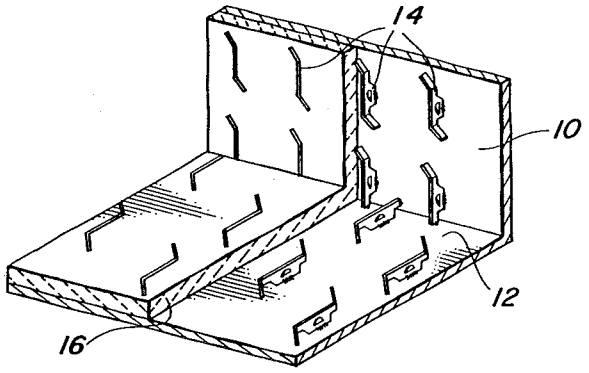
FIG. 3 is a perspective view, partially cut away, showing an insulated structure incorporating S-bar anchors.

Referring first to FIG. 3, which shows a portion of an insulated metal structure having sides 10 and 12, a series of S-bar anchors 14 (to be described in more detail below) are welded to the inner surfaces of sides 10 and 12 in a pattern. A layer of refractory insulation 16 covers the inner surfaces of sides 10 and 12 to a depth equal to the height of anchors 14, so that the insulation protects the structure from heat while the anchors help hold the insulation in place and also prevent erosion of the insulation.

Figure 6:
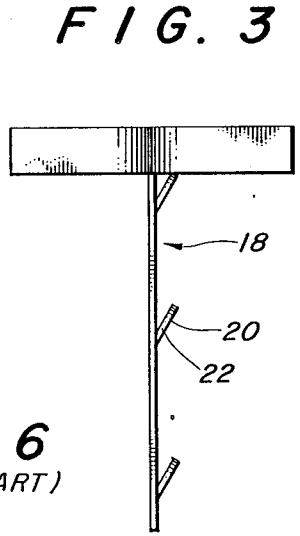
FIG. 6 (PRIOR ART)
FIGS. 6 and 7 are a perspective view and an end view, respectively, of a prior art S-bar anchor.
Figure 7:
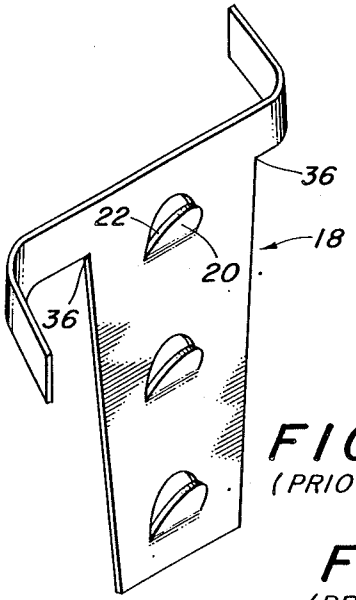
FIG. 7 (PRIOR ART)

As mentioned previously, prior art S-bar anchors 18 (FIGS. 6 and 7) include a tab or tabs 20 formed in the main body portion of the anchors 18. These tabs 20 are formed such that the sides 22 of tabs 20 intersect the bend line of the tab in the main body portion at essentially a right angle. These right angle intersections have proved to be the site of stress concentrations during service, and in cases of severe service the failure rate has been unacceptable.

Figure 2:
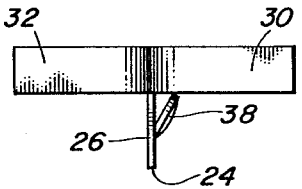
FIG. 2 is an end view of the anchor shown in FIG. 1.
Figure 1:
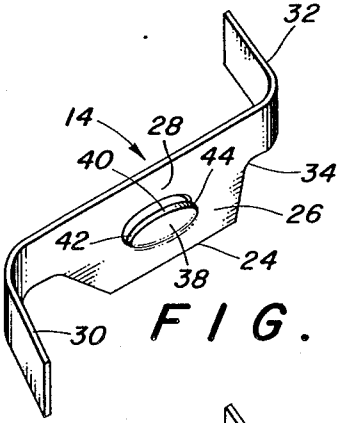
FIG. 1 is a perspective view of an S-bar anchor in accordance with the invention.

An S-bar anchor that is not subject to the stress concentrations of the prior art anchors is shown in FIGS. 1 and 2. This anchor is represented generally as 14 and includes a bottom edge 24 which is welded to a surface to be protected as shown in FIG. 3. Anchor 14 includes a main body section 26 extending from bottom edge 24 to top section 28, and arms 30 and 32 extending from each end of top section 28. The top of each arm 30 and 32 is the same height above the plane of bottom edge 24 as is the top edge of top section 28 (best seen in FIG. 2) so that when installed as in FIG. 3 the top edges can be coplanar with a smooth layer of insulation having a thickness equal to the height of the anchor. Arms 30 and 32 are bent in opposite directions (FIG. 1) to the approximate shape of the letter S when viewed from the top or bottom (from the bottom in FIG. 1). Thus, the term "S-bar anchor" has commonly been used to refer to anchors of this general configuration. The junctures of arms 30 and 32 with main body section 26 are smooth radius surfaces 34 (FIGS. 1 and 4), as opposed to a sharply angled juncture 36 in prior art anchors (FIG. 6), so that stress concentrations at these junctures are avoided in the anchors of the invention.

Essential to the improved anchors of the invention is at least one tab 38 (FIGS. 1 and 2) formed from main body section 26 and extending outwardly therefrom. Tab 38 is of generally elliptical shape with a top long side 40 and ends 42 and 44 (FIG. 1), and the portion of tab 40 that is connected to main body section 26 has a length less than the end-to-end dimension of tab 38 so the right angle junctures of prior art tabs are avoided, and the stress concentrations that resulted from prior art tab design do not occur in anchors having elliptical tabs in accordance with the invention.

Figure 5:
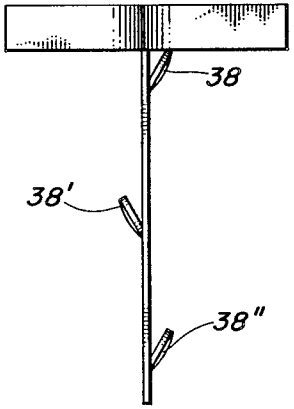
FIGS. 4 and 5 are a perspective view and an end view, respectively, of another embodiment of an S-bar anchor having a plurality of tabs extending from the main body portion.
Figure 4:
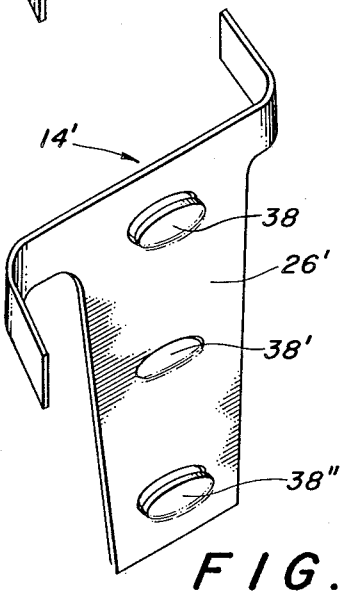

Another embodiment of the invention having additional features is shown in FIGS. 4 and 5. As seen in FIG. 4, anchor 14' is basically similar to the FIG. 1 version except that main body section 26' is longer, and additional elliptical tabs 38' and 38'' are included on the main body section. Tabs 38, 38' and 38'' are all identical except that tab 38' extends from the main body section on the opposite side from tabs 38 and 38''. This alternating tab version provides better holding power in some cases than when all the tabs extend in the same direction.

Variations in the anchors are described above will be apparent, and are intended to be included within the scope of the invention as defined by the appended claims.

I claim:

1. In a metal refractory anchor formed from a sheet of metal and having a bottom edge, a body section extending from said bottom edge to a top section, an arm extending from each end of said top section such that the top of each of said arms is the same height above the plane of said bottom edge as is the top edge of said top section, said extending arms being bent in opposite directions to the approximate shape of the letter S, and at least one projecting tab formed in the body section thereof, the improvement wherein:

said projecting tap is formed in a generally elliptical shape with two long sides and two ends wherein one of said long sides and both ends of said tab extend from said body section and a portion of the other of said long sides of said tab forms a juncture of said tab and said body portion, whereby the portion of said tab connected to said body section has a length less than the end-to-end dimension of said tab.

2. A metal refractory anchor in accordance with claim 1 wherein a plurality of projecting tabs of generally elliptical shape are formed in said body section.

* * * * *